US009237791B2

(12) United States Patent
Hirst

(10) Patent No.: US 9,237,791 B2
(45) Date of Patent: Jan. 19, 2016

(54) COSMETIC CONTAINER

(75) Inventor: Kenneth William Hirst, New York, NY (US)

(73) Assignee: MARK KAY INC., Addison, TX (US)

( * ) Notice: Subject to any disclaimer, the term of this patent is extended or adjusted under 35 U.S.C. 154(b) by 1487 days.

(21) Appl. No.: 11/861,981

(22) Filed: Sep. 26, 2007

(65) Prior Publication Data

US 2008/0078419 A1 Apr. 3, 2008

Related U.S. Application Data

(60) Provisional application No. 60/827,512, filed on Sep. 29, 2006.

(51) Int. Cl.

| | |
|---|---|
| ***A45D 33/00*** | (2006.01) |
| ***A45D 33/28*** | (2006.01) |
| *A45D 40/24* | (2006.01) |

(52) U.S. Cl.

CPC ..... *A45D 33/006* (2013.01); *A45D 33/28* (2013.01); *A45D 40/24* (2013.01); *A45D 2200/052* (2013.01)

(58) Field of Classification Search

CPC ... A45D 33/006; A45D 33/008; A45D 33/18; A45D 33/28

USPC ..... 132/293, 315, 294, 301, 297; 206/235, 206/581

See application file for complete search history.

(56) References Cited

U.S. PATENT DOCUMENTS

| | | | | |
|---|---|---|---|---|
| 1,642,611 | A * | 9/1927 | Kendall | 132/293 |
| 1,682,534 | A * | 8/1928 | Martinat | 132/297 |
| 2,013,197 | A | 9/1935 | Zipper | 132/83 |
| 3,637,278 | A | 1/1972 | Easterbrooks | 312/227 |
| 4,345,607 | A | 8/1982 | Contreras et al. | 132/83 R |
| 4,421,127 | A | 12/1983 | Geer | 132/83 R |
| D277,422 | S | 1/1985 | Bakic | D28/83 |
| D280,852 | S | 10/1985 | Bakic | D28/83 |
| D280,853 | S | 10/1985 | Bakic | D28/83 |
| D281,731 | S | 12/1985 | Phu | D28/83 |
| D282,300 | S | 1/1986 | Bakic | D28/83 |
| 4,589,430 | A | 5/1986 | Sussman | 132/82 D |
| D286,212 | S | 10/1986 | Campello et al. | D28/83 |
| D290,175 | S | 6/1987 | Bakic | D28/77 |

(Continued)

FOREIGN PATENT DOCUMENTS

| | | |
|---|---|---|
| FR | 2585935 | 2/1987 |
| GB | 489421 | 7/1938 |

(Continued)

OTHER PUBLICATIONS

"Taiwanese Search Report," issued in ROC (Taiwan) New Design Patent Application No. 095306425, dated Aug. 30, 2007.

(Continued)

*Primary Examiner* — Todd E Manahan
*Assistant Examiner* — Brianne Kalach
(74) *Attorney, Agent, or Firm* — Norton Rose Fulbright US LLP

(57) ABSTRACT

A container for holding cosmetics which has a base assembly, a cover member configured to engage the base assembly, and a receptacle retained by the base assembly. The base assembly and the receptacle are attracted by a magnetic force and a release lever extends between the base assembly and the receptacle.

21 Claims, 5 Drawing Sheets

(56) References Cited

U.S. PATENT DOCUMENTS

| | | | | | |
|---|---|---|---|---|---|
| 4,693,392 | A | | 9/1987 | Contreras | 220/343 |
| D293,612 | S | | 1/1988 | Bulwik | D28/83 |
| 4,858,765 | A | | 8/1989 | Nakamura | 206/581 |
| 4,917,131 | A | | 4/1990 | Contreras | 132/301 |
| D316,462 | S | | 4/1991 | Restrepo | D28/83 |
| 5,005,697 | A | * | 4/1991 | Jimbo et al. | 132/294 |
| 5,092,354 | A | | 3/1992 | Pacelli | 132/294 |
| 5,127,568 | A | | 7/1992 | Unuma et al. | 226/74 |
| 5,135,012 | A | * | 8/1992 | Kamen et al. | 132/294 |
| 5,199,451 | A | | 4/1993 | Montoli | 132/315 |
| D337,179 | S | | 7/1993 | Faure | D28/83 |
| 5,320,116 | A | | 6/1994 | Ackermann | 132/293 |
| 5,323,794 | A | | 6/1994 | Favre | 132/294 |
| 5,331,982 | A | | 7/1994 | Machelett | 132/301 |
| 5,373,862 | A | | 12/1994 | Blachut | 132/294 |
| 5,483,981 | A | | 1/1996 | Vandromme et al. | 132/315 |
| D373,952 | S | | 9/1996 | Exarhos et al. | D9/423 |
| 5,605,167 | A | | 2/1997 | Montoli | 132/294 |
| 5,638,839 | A | | 6/1997 | Montoli | 132/295 |
| 5,642,832 | A | | 7/1997 | Favre | 220/260 |
| 5,655,553 | A | * | 8/1997 | Giese et al. | 132/303 |
| 5,704,378 | A | | 1/1998 | Machelett | 132/304 |
| 5,713,381 | A | | 2/1998 | Sloane | 132/312 |
| 5,713,471 | A | | 2/1998 | Gueret | 206/581 |
| 5,735,297 | A | | 4/1998 | Litton | 132/294 |
| D398,079 | S | | 9/1998 | Denison | D28/82 |
| D407,855 | S | | 4/1999 | Orsomando | D28/83 |
| D407,856 | S | | 4/1999 | Orsomando | D28/83 |
| 5,950,639 | A | | 9/1999 | Suzuki et al. | 132/294 |
| D424,752 | S | | 5/2000 | Thorpe | D28/82 |
| D428,208 | S | | 7/2000 | Nodarse | D28/77 |
| D433,773 | S | | 11/2000 | Gavin | D28/83 |
| D439,019 | S | | 3/2001 | Motosko | D28/83 |
| D445,563 | S | | 7/2001 | Cautereels | D3/205 |
| 6,311,701 | B1 | | 11/2001 | Yuhara et al. | 132/294 |
| D478,397 | S | | 8/2003 | Bakic | D28/83 |
| D478,689 | S | | 8/2003 | Thorpe | D28/83 |
| D481,493 | S | | 10/2003 | Chen | D28/73 |
| D488,263 | S | | 4/2004 | Thorpe et al. | D28/83 |
| D498,879 | S | | 11/2004 | Martinez | D28/83 |
| 6,857,432 | B2 | | 2/2005 | Laforcade | 132/294 |
| D503,245 | S | | 3/2005 | Vanoncini | D28/78 |
| D504,743 | S | | 5/2005 | Kostow | D28/78 |
| D505,752 | S | | 5/2005 | Martinez | D28/83 |
| D506,752 | S | | 6/2005 | Huh | D14/316 |
| 6,932,220 | B2 | | 8/2005 | Byun | 206/581 |
| D511,025 | S | | 10/2005 | Martinez | D28/83 |
| D512,533 | S | | 12/2005 | Martinez | D28/83 |
| D518,603 | S | | 4/2006 | Dittmer et al. | D28/83 |
| 7,047,983 | B2 | | 5/2006 | Manougian | 132/294 |
| 2004/0182413 | A1 | * | 9/2004 | de Laforcade | 132/293 |
| 2005/0199260 | A1 | | 9/2005 | Petit | 132/301 |
| 2006/0118454 | A1 | | 6/2006 | Kang | 206/581 |

FOREIGN PATENT DOCUMENTS

| | | |
|---|---|---|
| JP | 61 8003 | 1/1986 |
| JP | D1141566 | 5/2002 |
| JP | D1285274 | 11/2006 |
| TW | 550028 | 8/2003 |
| TW | D105007 | 6/2005 |
| WO | WO 86/00600 | 1/1986 |

OTHER PUBLICATIONS

PCT International Search Report and Written Opinion, issued in International Application No. PCT/US2007/079873, dated Jul. 21, 2008.

Partial International Search Report issued in International Patent Application No. PCT/US2007/079873, dated Feb. 29, 2008.

Office Communication, issued in Chinese Patent Application No. 200780036575, dated Mar. 8, 2011.

* cited by examiner

COSMETIC CONTAINER

CROSS-REFERENCE TO RELATED APPLICATIONS

This application claims the benefit of U.S. Provisional Application No. 60/827,512, filed Sep. 29, 2006, the contents of which is incorporated by reference.

BACKGROUND OF THE INVENTION

1. Field of the Invention

Embodiments of the present invention relate generally to containers for holding cosmetic products, sometimes referred to as compacts or vanity cases.

2. Description of Related Art

Cosmetic containers or compacts typically hold several small cosmetic products such as a lipstick tube, makeup pan or tray, mirror, and a makeup applicator such as a brush. It is desirable that these containers are small in size, so that the containers can easily be carried in a purse or pocket. Because the containers often carry such a variety of cosmetic products, it is important that the products be efficiently arranged to maximize the available space. In addition, the products must also be firmly retained in the compact because the compact will be carried around in a purse or pocket and likely jostled during transport. The compact should also be firmly retained in a closed position to prevent products from accidentally spilling out of the compact. Furthermore, some of the products, such as makeup pans or receptacles, will need to be removed from time to time for a variety of reasons. For example, a user may desire to remove a makeup pan because the pan is empty or to insert a pan with a different color makeup. It is therefore desired that the makeup pan be easily removed when desired, but firmly retained when it is not necessary to change makeup pans.

Many compacts require the user to pry up directly on the makeup pan when the user desires to remove the pan. Often, this is accomplished by the user with a fingernail, which may be damaged or broken during removal of the tray. Other compacts provide an aperture or hole in the back of the compact that allow a user to push the makeup pan from the backside and force it out of the compact. This method can be cumbersome in that it requires the user to blindly find the aperture or to turn the compact over and risk having the makeup pan fall completely out when the user presses on the pan from the back.

In addition, many compacts retain the makeup receptacle via a friction or press fit. This retention means generally requires a close dimensional tolerance between the receptacle and the component into which the receptacle is inserted. If the receptacle is inserted and removed numerous times, the clearance between the receptacle and the holder may increase, thereby reducing the capability of the holder to retain the cosmetic receptacle. A slight discrepancy in the dimensions of either the receptacle or the holder can create a substantial variation in the retaining force of the holder on the makeup receptacle. This variation in turn leads to large disparities in the amount of force required to remove the makeup receptacle.

It is therefore desirable to provide a cosmetic container that overcomes the deficiencies noted in prior apparatuses and methods.

SUMMARY OF THE INVENTION

Embodiments of the present disclosure provide a container and method for holding cosmetic products. In one non-limiting embodiment of the present disclosure, the container comprises a base assembly, a cover member, a receptacle retained by the base assembly, wherein the base assembly and the receptacle are attracted by a magnetic force. In certain aspects, the container comprises a release lever with a first member extending between the base assembly and the receptacle and a second member extending at an angle from the first member, wherein the release lever is configured to separate the receptacle from the base assembly upon an application of a manual force on the second member. In certain aspects, the cover member may comprise an aperture extending through the cover member and the base assembly may not comprise an aperture extending through the base assembly. In other aspects, the manual force may be applied in a direction towards the base assembly, the base assembly may comprise a magnet and the receptacle may comprise a ferromagnetic material. In still other aspects, the base assembly may comprise a ferromagnetic material and the receptacle may comprise a magnet that comprises a notch, wherein the first member of the release lever extends into the notch.

In certain non-limiting embodiments, the base assembly comprises a curved depression and the cover member and base assembly are hinged together wherein the cover member is configured to rotate from a closed position to an open position. In still other aspects, the cover member comprises an aperture aligned with the curved depression when the cover member is in the closed position, and the aperture and the depression are configured to retain a lipstick tube. In certain non-limiting embodiments, the container comprises a magnetic latch configured to retain the cover member in the closed position and a cosmetic instrument and the base assembly are attracted by a magnetic force. In certain aspects, the cosmetic instrument comprises a ferromagnetic material and the base assembly comprises a magnet. The base assembly may comprise an insert configured to retain the receptacle.

In certain non-limiting embodiments, the container comprises a base assembly, a hinge, and a cover member pivotally engaged with the base assembly via the hinge, wherein the cover member is configured to pivot from a closed position to an open position, the base assembly comprises a depression proximal to the hinge and the cover member comprises an aperture. The aperture may be aligned with the depression when the cover member is in the closed position, and the base assembly and cover member may comprise a magnetic latch distal from the hinge. In certain aspects, the depression is substantially parallel to the hinge. In other aspects, the curved depression is configured to receive a lipstick tube and the aperture is configured to allow a lipstick tube received in the curved depression to partially protrude through the aperture. In still other aspects a receptacle may be magnetically engaged with the base assembly, wherein the base assembly may comprise a magnet and the receptacle may comprise a ferromagnetic material. In still other aspects, the release lever may comprise a first member extending between the base assembly and the receptacle and a second member extending away from the base assembly, wherein the release lever is configured to separate the receptacle from the base assembly upon an application of a manual force on the second member. In certain aspects, the manual force may be applied in a direction towards the base assembly.

In certain aspects, the release lever may comprise a curved portion to engage a user's finger when activating the release lever. The release lever may be centered under the receptacle or may be offset to one side of a receptacle. The container may also include more than one receptacle. The cross section of the container may comprise a generally elliptical shape that rests comfortably in a user's hand. The curved depression may also comprise a substantially half-circular shape, and the cover may comprise a mirror. In certain aspects, the cosmetic instrument is a makeup brush.

In certain non-limiting embodiments, a method of removing a receptacle from a cosmetic container comprises the steps of: providing a receptacle retained by a base assembly of the cosmetic container; providing a release lever with a first member extending between the base assembly and the receptacle and a second member extending at an angle from the first member; applying a manual force on the second member; pivoting the release lever; and separating the receptacle from the base.

As used herein, the terms "a" and "an" are defined as one or more unless this disclosure explicitly requires otherwise.

The term "substantially" and its variations are defined as being largely but not necessarily wholly what is specified as understood by one of ordinary skill in the art, and in one non-limiting embodiment the term "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

The term "coupled," as used herein, is defined as connected, although not necessarily directly, and not necessarily mechanically.

Other features and associated advantages will become apparent with reference to the following detailed description of specific, example embodiments in connection with the accompanying drawings.

BRIEF DESCRIPTION OF THE DRAWINGS

The following drawings form part of the present specification and are included to further demonstrate certain aspects of the invention. The invention may be better understood by reference to one or more of these drawings in combination with the detailed description of example embodiments presented here. The drawings are not to scale, and certain distances or spacings may be exaggerated to provide clarity. The drawings are examples only. They do not limit the claims.

DESCRIPTION OF ILLUSTRATIVE EMBODIMENTS

Embodiments of this disclosure provide a method and apparatus for containing cosmetic products.

Figure 1:
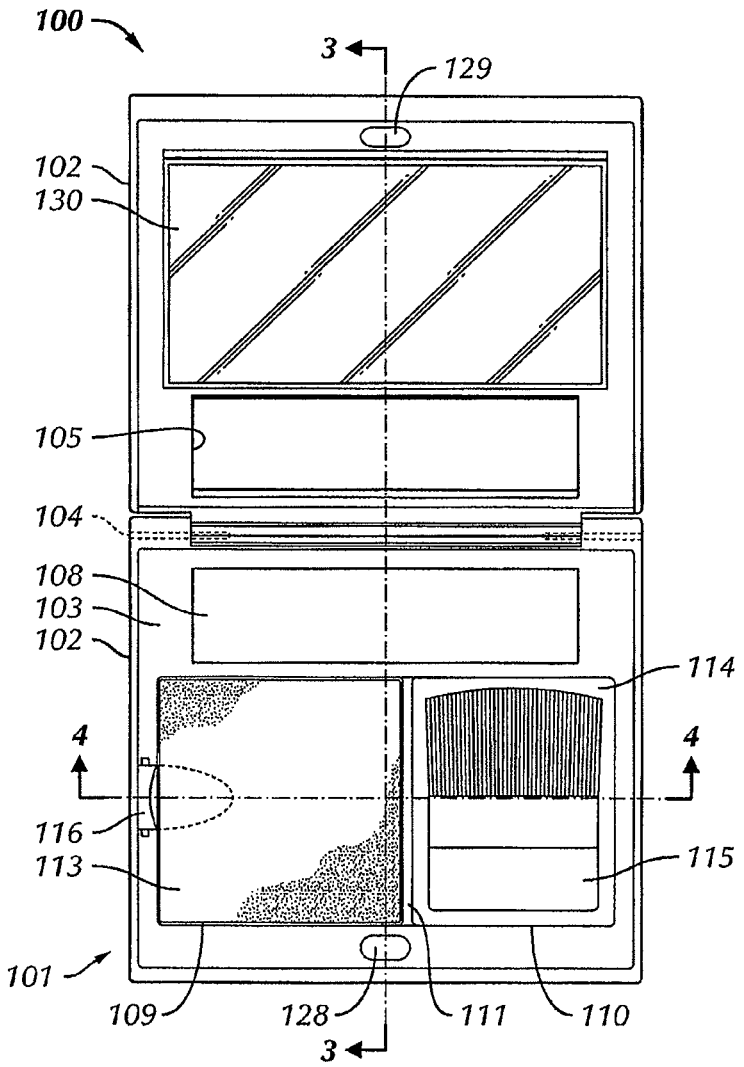
FIG. 1 is a top view of a container in an open position, in accordance with embodiments of this disclosure.
Figure 2:
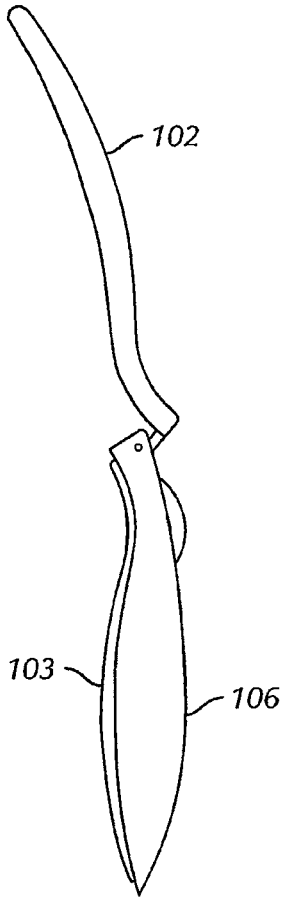
FIG. 2 is a side view of a container in an open position, in accordance with embodiments of this disclosure.
Figure 3:
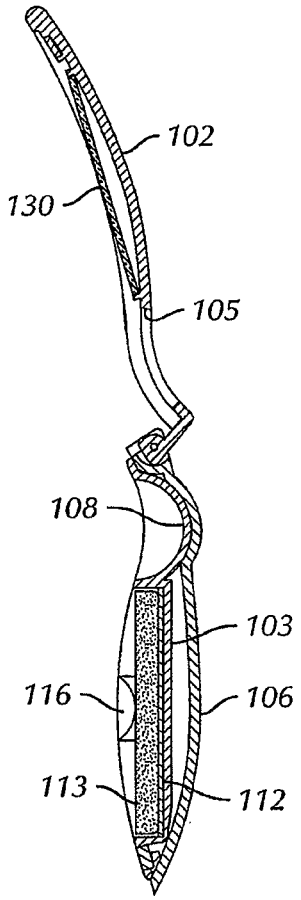
FIG. 3 is a section side view of a container in an open position, in accordance with embodiments of this disclosure.
Figure 3A:
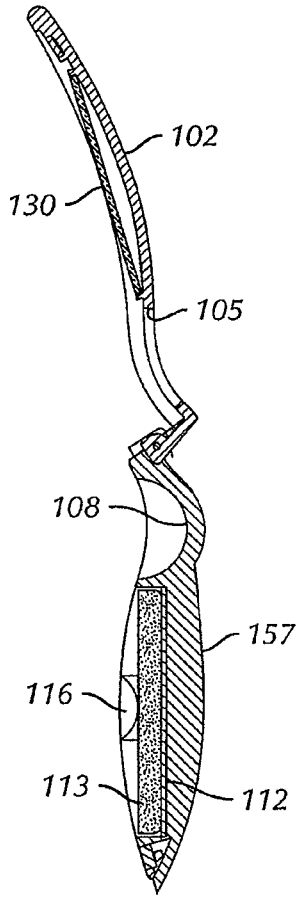
FIG. 3A is a section side view of an alternative embodiment of a container in an open position, in accordance with embodiments of this disclosure.
Figure 4:
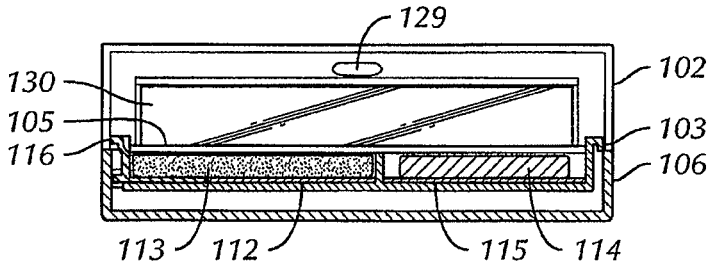
FIG. 4 is a section front view of a container in an open position, in accordance with embodiments of this disclosure.

Referring initially to FIGS. 1-4, a cosmetic container 100 comprises a base assembly 101 and a cover member 102. Cover member 102 is shown in an open position in FIGS. 1-3 and is pivotally engaged with base assembly 101 via a hinge 104. FIG. 3 is a side section view taken along section line 3-3 in FIG. 1 and FIG. 4 is a front section view taken along section line 4-4 in FIG. 1. In the embodiment shown in FIGS. 1-3 and 4, base assembly 101 comprises an insert 103 engaged with a base member 106 via a snap or friction fit (or other suitable retention methods known by one skilled in the art). In an alternative embodiment shown in FIG. 3A, a base assembly 157 comprises a unitary piece that instead of a separate insert and base member. In the embodiment of FIG. 3A, base assembly 157 is equivalent to the combination of insert 103 and base member 106, with the exception that base assembly 157 is a unitary piece rather than separate components. It will be understood by one skilled in the art that each of the features of insert 103 and/or base member 106 described below may also be integral to base assembly 157 in the embodiment of FIG. 3A.

Figure 9:
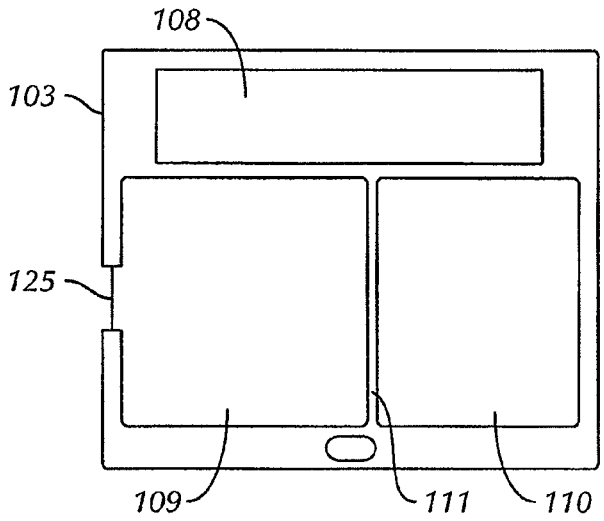
FIG. 9 is a top view of an insert, in accordance with embodiments of this disclosure.
Figure 10:
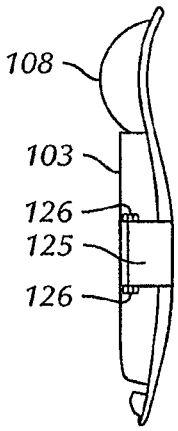
FIG. 10 is a side view of an insert, in accordance with embodiments of this disclosure.

In the embodiment shown in FIGS. 1-4, cover member 102 comprises an aperture 105, a mirror 130 and a magnetic latch 129. Referring additionally to FIGS. 9 and 10, insert 103 comprises a magnetic latch 128, a depression 108, a pair of indentations 109, 110 and a divider 111 between indentations 109, 110. As best shown in FIGS. 1 and 4, a magnet 112 is retained in indentation 109 and a cosmetic or makeup pan or receptacle 113 is attracted to magnet 112 via a magnetic force. In the embodiment shown, a magnet 114 is also retained in indentation 110 and is attracted to a cosmetic or makeup instrument 115 via a magnetic force. In certain embodiments, makeup instrument 115 is a brush or other instrument for applying makeup. In the embodiment shown, makeup receptacle 113 and makeup instrument 115 are comprised of a ferromagnetic material, therefore allowing magnets 112, 114 to retain makeup receptacle 113 and makeup instrument 115. In other embodiments, makeup receptacle 113 and makeup instrument 115 may comprise magnetic material and indentations 109, 110 may comprise ferromagnetic material. In still other embodiments, makeup receptacle 113, makeup instrument 115, and indentations 109, 110 may all comprise magnetic material. Magnet 112 and receptacle 113 can be configured so that the magnetic force attracting the components is suitable to retain receptacle 113, yet allow receptacle 113 to be easily separated via a release lever 116 when the user so desires. A potential advantage of utilizing a magnetic force to retain receptacle 113, as opposed to a friction or snap fit, is that the retaining force should remain consistent even after receptacle 113 has been installed and removed numerous times. In addition, components retained with magnetic force should not require the close dimensional tolerances normally required of components retained by friction or snap fits. Magnets 112, 114 may be retained in indentations 109, 110, respectively, via adhesive, friction fit, or other suitable means known by one skilled in the art.

Figure 5:
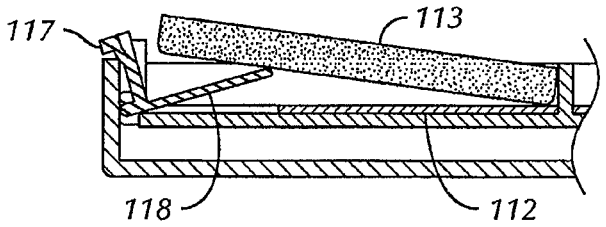
FIG. 5 is a partial front section view, in accordance with embodiments of this disclosure.
Figure 6:
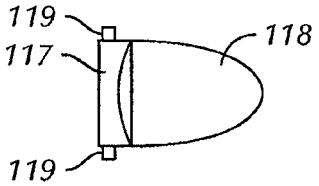
FIG. 6 is a top view of a release lever, in accordance with embodiments of this disclosure.
Figure 7:
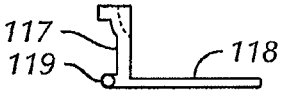
FIG. 7 is a front view of a release lever, in accordance with embodiments of this disclosure.
Figure 8:
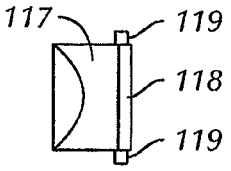
FIG. 8 is a side view of a release lever, in accordance with embodiments of this disclosure.

As shown in the embodiment of FIGS. 1 and 4, release lever 116 is engaged with insert 103. A detailed view of release lever 116 in operation is shown in FIG. 5, and orthographic views of release lever 116 are shown in FIGS. 6-8. In the embodiment shown, release lever 116 comprises an engagement member 117, a release member 118 extending at an angle away from engagement member 117, and a pair of pins 119 that engage insert 103. Referring now to the embodiment shown in FIGS. 9 and 10, insert 103 comprises a slot 125 configured to receive release lever 116. Insert 103 further comprises a pair of channels 126 configured to receive pins 119 of release lever 116 in the embodiment shown.

As shown in FIG. 5, release lever 116 can be slightly rotated about pins 119 so that release member 118 separates makeup receptacle 113 from magnet 112. In the embodiment shown, a user can apply a manual force to engagement member 117 in a direction towards base assembly 107. In the position shown in FIG. 5, a manual force applied in a direction down and to the left will cause release lever 116 to rotate counter-clockwise so that release member 118 lifts up makeup receptacle 113 and separates it from magnet 112 and base assembly 107. In this manner, a user can easily remove makeup receptacle 113 without having to pry or force it away from base assembly 107.

Release lever 116 is configured to allow a user to press down on engagement member 117 rather than pull up directly on makeup receptacle 113 when the user desires to remove makeup receptacle 113. As shown in FIGS. 6 and 8, engagement member 117 is curved to provide a comfortable surface for a user to place his or her finger when utilizing release lever 116. By pressing in a direction towards base assembly 117, rather than prying up directly on makeup receptacle 113, a user should be less likely to break a fingernail. Use of release lever 116 should also require less manual dexterity than prying directly on makeup receptacle 113 with a fingernail. The dimensions of release lever 116 can be configured so that a desired amount of manual force applied by the user is needed to overcome the magnetic force attracting receptacle 113 to magnet 112. As explained above, the use of a magnetic force to retain receptacle 113 provides.

Figure 11:
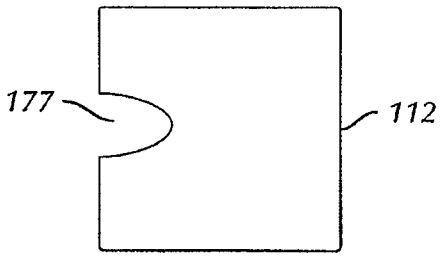
FIG. 11 is a top view of a magnet, in accordance with embodiments of this disclosure.

In the embodiment shown in FIG. 11, magnet 112 comprises a notch 177 that receives release member 118. As shown in the front section view of FIG. 4, this configuration allows both release member 118 and magnet 112 to lay flat on insert 103. The configuration shown in FIG. 4 therefore has a reduced cross-sectional thickness as compared to a configuration where release member 118 is placed between magnet 112 and makeup receptacle 113.

Figure 12:
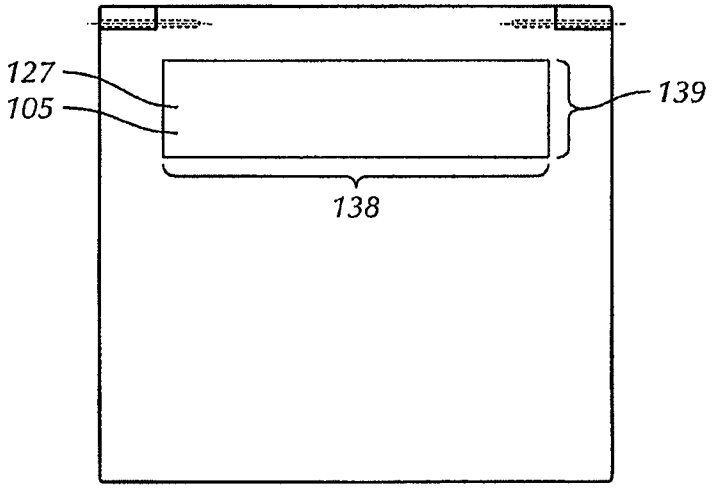
FIG. 12 is a top view of a container in a closed position, in accordance with embodiments of this disclosure.
Figure 13:
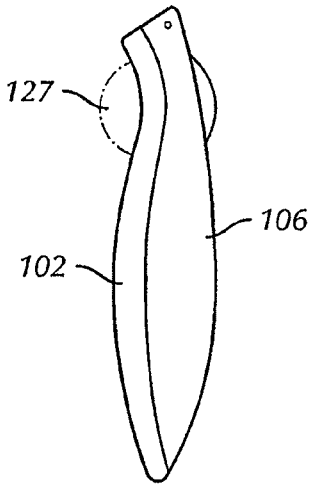
FIG. 13 is a side view of a container in a closed position, in accordance with embodiments of this disclosure.
Figure 14:
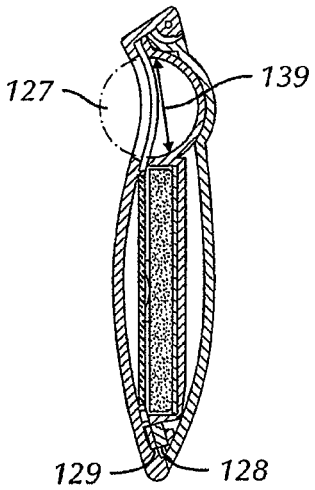
FIG. 14 is a section side view of a container in a closed position, in accordance with embodiments of this disclosure

Referring now to FIGS. 12-14, base assembly 117 also comprises a depression 108 that aligns with aperture 105 when cover member 102 is in the closed position. In the embodiment shown, depression 108 is curved to receive a cosmetic product such as a lipstick tube 127. In a preferred method, cosmetic container 100 is placed in the open position so that cover member 102 is in the general position shown in FIGS. 1-4. Lipstick tube 127 can then be placed in depression 108 and cover member 102 rotated so that it is placed in the closed position shown in FIGS. 12-14. Aperture 105 is configured so that lipstick tube 127 can partially protrude through aperture 105. Aperture 105 has a width 138 that is less than a diameter 139 of lipstick tube 127 so that lipstick tube 127 cannot pass through aperture 105. Aperture 105 allows a user to see lipstick tube 127 (or another cosmetic product configured to be retained by aperture 105) while lipstick tube 127 is still retained in cosmetic container 100. In this manner, it may be possible for a user to determine if lipstick tube 127 is retained in cosmetic container 100 without opening cover member 102. In addition, a user may be able to determine product information, such as color, about lipstick tube 127 via aperture 105 without opening cover member 102.

As shown in FIG. 14, when cover member 102 is in the closed position, magnetic latch 129 engages magnetic latch 128 to retain cover member 102 in the closed position. It is understood by one skilled in the art that magnetic latches 128 and 129 comprise a combination of ferromagnetic and/or magnetic material so that magnetic latches 128 and 129 are attracted by magnetic force. A user may open cover member 102 by overcoming the magnetic force attracting magnetic latches 128 and 129 together. However, magnetic latches 128, 129 are configured to prevent cover member 102 from inadvertently opening up.

In a preferred embodiment shown in FIGS. 1-3 and 12-14, depression 108 and aperture 105 are proximal to and substantially parallel to hinge 104. In this configuration, depression 108 is distal to magnetic latches 128, 129 which may be preferable in the event that a cosmetic product such as lipstick tube 127 comprises ferromagnetic or magnetic material. Such a configuration reduces the likelihood that lipstick tube 127 (or any cosmetic product retained in depression 108) will be inadvertently withdrawn from depression 108 by a magnetic attraction to magnetic latch 129 while opening cover member. In addition, by placing aperture 105 proximal to and substantially parallel to hinge 104, mirror 130 may be configured to extend substantially across the width of cover member 102. Maximizing the width of mirror 130 should be beneficial to a user by allowing the user to see a larger area when applying cosmetic products.

The above text describes preferred embodiments of the invention. It should be appreciated by those of skill in the art that many changes can be made in the specific embodiments which are disclosed and still obtain a like or similar result without departing from the spirit and scope of the invention. For example, other embodiments may comprise more than one makeup receptacle. In still other embodiments, the release lever may be located in a different location such that the release lever is offset to one side of the indentation that retains the makeup receptacle or receptacles.

What is claimed is:

1. A container for holding cosmetic products, comprising:

a base assembly defining an indentation spanning only a portion of the base assembly, the indentation configured to receive a receptacle such that horizontal motion of the receptacle is substantially prevented;

a cover member configured to engage the base assembly;

a receptacle removably retained in the indentation by the base assembly, wherein the base assembly and the receptacle are attracted by a magnetic force configured to retain the receptacle without protrusions extending from the base assembly; and a release lever pivotally coupled to the base assembly, the release lever comprising:

a first member extending between the base assembly and the receptacle;

a second member extending at an angle from the first member, wherein the release lever is configured to separate the receptacle from the base assembly upon an application of a manual force on the second member.

2. The container of claim 1 wherein the cover member comprises an aperture extending through the cover member and the base assembly does not comprise an aperture extending through the base assembly.

3. The container of claim 1 wherein the manual force is applied in a direction towards the base assembly.

4. The container of claim 1 wherein the base assembly comprises a magnet and the receptacle comprises a ferromagnetic material.

5. The container of claim 1 wherein the base assembly comprises a ferromagnetic material and the receptacle comprises a magnet.

6. The container of claim 1 wherein:

the base assembly comprises a magnet;

the magnet comprises a notch;

the first member of the release lever extends into the notch.

7. The container of claim 1 wherein the base assembly comprises a curved depression distinct from the indentation.

8. The container of claim 1 wherein the base assembly and the cover member are hinged together and the cover member is configured to rotate from a closed position to an open position.

9. The container of claim 8 wherein:

the base assembly comprises an elongated depression proximal to the hinge and having a longitudinal axis that is substantially parallel to the axis of rotation of the hinge;

the cover member comprises an aperture aligned with the depression when the cover member is in the closed position.

10. The container of claim 9 wherein the aperture and the depression are configured to retain a lipstick tube.

11. The container of claim 8, further comprising a magnetic latch configured to retain the cover member in the closed position.

12. The container of claim 1, further comprising a cosmetic instrument, wherein the cosmetic instrument and the base assembly are attracted by a magnetic force.

13. The container of claim 12, wherein the cosmetic instrument comprises a ferromagnetic material and the base assembly comprises a magnet.

14. The container of claim 1, wherein the base assembly comprises an insert configured to retain the receptacle.

15. A container for holding cosmetic products, comprising:

a base assembly defining an indentation spanning only a portion of the base assembly, the indentation configured to receive a receptacle such that horizontal motion of the receptacle is substantially prevented;

a hinge; and a cover member pivotally engaged with the base assembly via the hinge, wherein:

the cover member is configured to pivot from a closed position to an open position;

the base assembly is configured to removably retain a receptacle in the indentation such that the base assembly and the receptacle are attracted by a magnetic force configured to retain the receptacle without protrusions extending from the base assembly;

the base assembly comprises an elongated depression proximal to the hinge and having a longitudinal axis that is substantially parallel to the axis of rotation of the hinge;

the cover member comprises an aperture;

the aperture is aligned with the depression when the cover member is in the closed position; and the base assembly and cover member comprise a magnetic latch distal from the hinge.

16. The container of claim 15 wherein:

the depression has a curved cross-section;

the curved depression is configured to receive a lipstick tube; and the aperture is configured to allow a lipstick tube received in the curved depression to partially protrude through the aperture.

17. The container of claim 15 further comprising:

a receptacle magnetically engaged with the base assembly.

18. The container of claim 17 wherein the base assembly comprises a magnet and the receptacle comprises a ferromagnetic material.

19. The container of claim 17 further comprising:

a release lever pivotally coupled to the base assembly, wherein the release lever comprises:

a first member extending between the base assembly and the receptacle;

a second member extending away from the base assembly;

wherein the release lever is configured to separate the receptacle from the base assembly upon an application of a manual force on the second member.

20. The container of claim 19 wherein the base assembly comprises a magnet having a notch, and the first member of the release lever extends into the notch.

21. The container of claim 20 wherein the manual force is applied in a direction towards the base assembly.

* * * * *